US008547196B2

(12) United States Patent
Higashikata

(10) Patent No.: US 8,547,196 B2
(45) Date of Patent: Oct. 1, 2013

(54) THERMALLY RESPONSIVE SWITCH

(75) Inventor: Isao Higashikata, Nagoya (JP)

(73) Assignee: Ubukata Industries Co., Ltd., Nagoya-Shi, Aichi (JP)

( * ) Notice: Subject to any disclaimer, the term of this patent is extended or adjusted under 35 U.S.C. 154(b) by 300 days.

(21) Appl. No.: 12/994,641

(22) PCT Filed: May 30, 2008

(86) PCT No.: PCT/JP2008/001377

§ 371 (c)(1), (2), (4) Date: Nov. 24, 2010

(87) PCT Pub. No.: WO2009/144771

PCT Pub. Date: Dec. 3, 2009

(65) Prior Publication Data

US 2011/0095860 A1 Apr. 28, 2011

(51) Int. Cl.
*H01H 37/02* (2006.01)

(52) U.S. Cl.
USPC ..... 337/368; 337/298; 337/343; 337/362; 337/365; 337/380; 337/377

(58) Field of Classification Search
USPC ..... 337/101, 102, 107, 112, 298, 343, 337/362, 380, 365, 368, 377
See application file for complete search history.

(56) References Cited

U.S. PATENT DOCUMENTS 3,586,910 A * 6/1971 Sauber ..... 361/22
3,871,939 A * 3/1975 Woods ..... 156/293
3,902,149 A * 8/1975 Senor ..... 337/110
4,041,432 A * 8/1977 Yarworth et al. ..... 337/111
4,092,573 A * 5/1978 D'Entremont ..... 318/783
4,114,127 A * 9/1978 Pejouhy ..... 337/97
4,136,323 A * 1/1979 D'Entremont et al. ..... 337/107
4,167,721 A * 9/1979 Senor et al. ..... 337/112
4,224,591 A * 9/1980 Senor ..... 337/102

(Continued)

FOREIGN PATENT DOCUMENTS

CN 1106506 A 8/1995
CN 1161748 A 10/1997

(Continued)

OTHER PUBLICATIONS

International Search Report for PCT/JP2008/001377, dated Jul. 15, 2008.

(Continued)

*Primary Examiner* — Anatoly Vortman
(74) *Attorney, Agent, or Firm* — Thomas & Karceski, PC

(57) ABSTRACT

A thermally responsive switch includes a hermetic container including a housing and a header plate hermetically secured to an open end of the housing, a conductive terminal pin inserted through the header plate, a conductive pin, a thermally responsive plate having one of two ends fixed to the terminal pin, a movable contact secured to the other end of the thermally responsive plate, and a fixed contact fixed via an electrical conductor to the terminal pin, the conductor having a fuse part and a heater. The fixed contact is fixed to a ceramic member disposed between the container and the fixed contact. The housing includes a bottom surface including both lengthwise ends between which the conductive pin is interposed. Both ends of the housing bottom surface are deformed axially relative to the conductive pin from an initial state, so that an operating temperature of the switch is calibratable.

8 Claims, 7 Drawing Sheets

(56) References Cited

U.S. PATENT DOCUMENTS

| | | | | | |
|---|---|---|---|---|---|
| 4,231,010 | A | * | 10/1980 | Cardin | 337/94 |
| 4,287,499 | A | * | 9/1981 | Pejouhy | 337/97 |
| 4,376,926 | A | * | 3/1983 | Senor | 337/104 |
| 4,399,423 | A | * | 8/1983 | Nield | 337/102 |
| 4,476,452 | A | * | 10/1984 | D'Entremont | 337/102 |
| 4,499,517 | A | * | 2/1985 | Lisauskas | 361/24 |
| 4,555,686 | A | * | 11/1985 | Pejouhy et al. | 337/102 |
| 4,646,195 | A | * | 2/1987 | Lisauskas | 361/25 |
| 4,791,329 | A | * | 12/1988 | Ubukata et al. | 310/68 C |
| 4,843,363 | A | * | 6/1989 | Ubukata et al. | 337/94 |
| 4,866,408 | A | * | 9/1989 | Petraitis et al. | 337/104 |
| 5,015,985 | A | | 5/1991 | Ubukata et al. | |
| 5,107,241 | A | * | 4/1992 | Ubukata et al. | 337/368 |
| 5,118,260 | A | * | 6/1992 | Fraser, Jr. | 417/18 |
| 5,196,820 | A | * | 3/1993 | Ubukata et al. | 337/368 |
| 5,212,465 | A | * | 5/1993 | Mizutani et al. | 337/368 |
| 5,221,914 | A | * | 6/1993 | Ubukata et al. | 337/13 |
| 5,509,786 | A | * | 4/1996 | Mizutani et al. | 417/32 |
| 5,515,217 | A | * | 5/1996 | Higashikata et al. | 361/22 |
| 5,721,525 | A | * | 2/1998 | Hofsass | 337/102 |
| 5,757,261 | A | * | 5/1998 | Becher et al. | 337/377 |
| 5,939,970 | A | * | 8/1999 | Tsuji et al. | 337/343 |
| 5,973,587 | A | * | 10/1999 | Hofsass | 337/377 |
| 6,005,471 | A | * | 12/1999 | Higashikata et al. | 337/347 |
| 6,142,741 | A | * | 11/2000 | Nishihata et al. | 417/32 |
| 6,154,117 | A | * | 11/2000 | Sato et al. | 337/365 |
| 6,249,211 | B1 | * | 6/2001 | Hofsaess | 337/377 |
| 6,674,620 | B2 | * | 1/2004 | Lamborghini et al. | 361/26 |
| 2003/0102954 | A1 | * | 6/2003 | Herrick | 337/102 |
| 2004/0100351 | A1 | * | 5/2004 | Unno et al. | 337/100 |
| 2005/0264393 | A1 | * | 12/2005 | Yamada | 337/85 |
| 2007/0262844 | A1 | * | 11/2007 | Pisuk et al. | 337/333 |

FOREIGN PATENT DOCUMENTS

| | | | | |
|---|---|---|---|---|
| CN | 101090045 | A | | 12/2007 |
| JP | 02139820 | A | * | 5/1990 |
| JP | 05-321853 | | | 12/1993 |
| JP | 06-96649 | | | 4/1994 |
| JP | 06-295651 | | | 10/1994 |
| JP | 2519530 | | | 5/1996 |
| JP | 10-073082 | | | 3/1998 |
| JP | 10-144189 | | | 5/1998 |
| JP | 2003-059379 | | | 2/2003 |
| JP | 2007-305586 | | | 11/2007 |
| RU | 23525 | U1 | | 6/2002 |

OTHER PUBLICATIONS

Office Action mailed May 31, 2012, in corresponding Korean Patent Application No. 10-2010-7028442.

Office Action mailed Mar. 28, 2012, in corresponding Russian Patent Application No. 2010154286.

Written Opinion of the International Searching Authority for International Patent Application No. PCT/JP2008/001377, mailed Jul. 15, 2008.

Notification of Reasons for Refusal dated Nov. 6, 2012, for corresponding Japanese Patent Application No. 2010-51268.

First Office Action dated Jan. 17, 2013, for corresponding Chinese Patent Application No. 200880129572.2.

* cited by examiner

THERMALLY RESPONSIVE SWITCH

CROSS-REFERENCE TO RELATED APPLICATION(S)

This is a National Stage Entry into the United States Patent and Trademark Office from International PCT Patent Application No. PCT/JP2008/001377, having an international filing date of 30 May 2008, the contents of which are incorporated herein by reference.

FIELD OF THE INVENTION

The present invention relates to a thermally responsive switch having a contact switching mechanism using a thermally responsive plate such as a bimetal in a hermetic container.

RELATED ART

Thermally responsive switches of the above-mentioned type are disclosed in Japanese Patent No. 2519530 (prior art document 1) and Japanese Patent Application Publication JP-A-H10-144189 (prior art document 2) and so on. The thermally responsive switch described in each document comprises a thermally responsive plate provided in a hermetic container including a metal housing and a header plate. A fixed contact is attached via a support to an inner part of the hermetic container. Furthermore, the thermally responsive plate has one end fixed via a support to an inner surface of the hermetic container and the other end to which a movable contact is secured. The movable and fixed contacts constitute a switching contact.

The foregoing thermally responsive switch is mounted in a closed housing of a hermetic electric compressor thereby to be used as a thermal protector for an electric motor of the compressor, as disclosed by Japanese Patent No. 3010141 (prior art document 3), for example. In this case, windings of the motor are connected to the terminal pin or the header plate. The thermally responsive plate reverses the direction of its curvature when a temperature around the thermally responsive switch rises unusually high or when an abnormal current flows in the motor. When the temperature drops to or below a predetermined value, the contacts are re-closed such that the compressor motor is re-energized.

SUMMARY OF THE INVENTION

The thermally responsive switch is required to open the contacts upon every occurrence of the aforesaid abnormal condition until a refrigerating machine or air conditioner in which the compressor is built reaches an end of the product's life. The thermally responsive switch needs to cut off current that is much larger than a rated current of the motor, particularly when the motor is driven in a locked rotor condition or when a short occurs between the motor windings. When current having such a large inductivity is cut off by the opening of contacts, an arc is generated between the contacts, whereupon the contact surfaces are damaged by heat due to the arc. The welding of contacts occurs when the switching of contacts exceeds a guaranteed operation number (i.e., a predetermined number of switching operations). In this regard, in order that an electric path may be cut off even upon occurrence of contact welding for the purpose of preventing a secondary abnormality, a part of the electric path needs to include a heater having a fuse part which melts in response to a very large current (see prior art documents 1 and 2), whereby double safety and protective measures need to be taken.

On the other hand, the thermally responsive switches are in many cases mounted inside closed housings of hermetic electric compressors (see prior art document 3). Particularly in lower-capacity compressors, however, a mounting location and a mounting manner need to be determined so that electrical insulating properties are secured. This complicates the process and increases costs. As a result, thermally responsive switches are not easily employed as thermal protectors for hermetic electric compressors.

In view of the above-described problem, a configuration has now been proposed in which the thermally responsive switch is provided integrally with a hermetic conductive terminal hermetically fixed to the housing of the hermetic electric compressor. In this case, a switching contact of the thermally responsive switch is disposed on one of a plurality of terminal pins hermetically fixed to the hermetic conductive terminal, as disclosed in Japanese Patent Application Publication JP-A-H05-321853 (prior art document 4), for example. Furthermore, the heater, having the fuse part as described above, is configured as a support for a fixed contact. Consequently, the thermally responsive switch can be reduced in size and employed as a thermal protector for lower-capacity compressors.

However, in the configuration that the heater with the fuse part serves as a support for the fixed contact, nothing can support the fixed contact when the fuse part has been melted down by a very large current. The fixed contact, which is movable in the hermetic container, is brought into contact with the hermetic container, thereby possibly forming an electric path.

An object of the disclosure is to provide a thermally responsive switch which can prevent the fixed contact from contacting with the hermetic container even when the fuse part supporting the fixed contact has melted down.

The present disclosure provides a thermally responsive switch, which is used to interrupt AC current flowing into an electric motor provided in a hermetic electric compressor, the switch comprising a hermetic container including a metal housing and a header plate hermetically secured to an open end of the housing, the housing being formed into a cylindrical shape and having a bottom, a conductive terminal pin inserted through a through hole formed through the header plate and hermetically fixed in the through hole by an electrically insulating filler, a conductive pin inserted through a through hole formed through the bottom of the housing and hermetically fixed in the through hole by the electrically insulating filler, a thermally responsive plate having one of two ends conductively connected and fixed to the conductive terminal pin in the hermetic container, the thermally responsive plate being formed into a dish shape by drawing so as to reverse a direction of curvature thereof at a predetermined temperature, a movable contact secured to the other end of the thermally responsive plate, and a fixed contact fixed via an electrical conductor to the terminal pin in the container, the conductor having a fuse part and a heater, the fixed contact constituting a pair of switching contacts together with the movable contact, characterized in that the fixed contact is fixed to an electrically insulating ceramic member disposed between the container and the fixed contact. The ceramic member is disposed so as to be movable axially relative to the terminal pin in the container and the housing includes a bottom surface further including both lengthwise ends between which the conductive pin is interposed, said both ends of the bottom surface of the housing being deformed axially relative to the conductive pin from an initial state, whereby an operating temperature of the thermally responsive switch is calibratable.

Furthermore, the compressor includes a housing to which a hermetic conductive terminal is fixed, the header plate is constituted by apart of the terminal, and the container is provided in the housing of the compressor.

Furthermore, the housing is formed into an elliptic shape that is long in a direction substantially perpendicular to an axial direction of the conductive pin, and the ceramic member is formed into an elliptic shape along with an inner circumferential surface of the housing.

Furthermore, the ceramic member has a recess surrounded by an outer elliptic annular circumferential wall, the conductor is formed into an elliptic annular shape that is located inside the circumferential wall, and the fixed contact is attached to the other end of the conductor in the recess and thereafter fixed to the ceramic member.

According to the thermally responsive switch of the present invention, even when the fuse part supporting the fixed contact is melted down, the fixed contact can be prevented from contact with the hermetic container by the electrically insulating ceramic member disposed between the fixed contact and the hermetic container.

DETAILED DESCRIPTION OF EMBODIMENT(S) OF THE INVENTION

Figure 7:
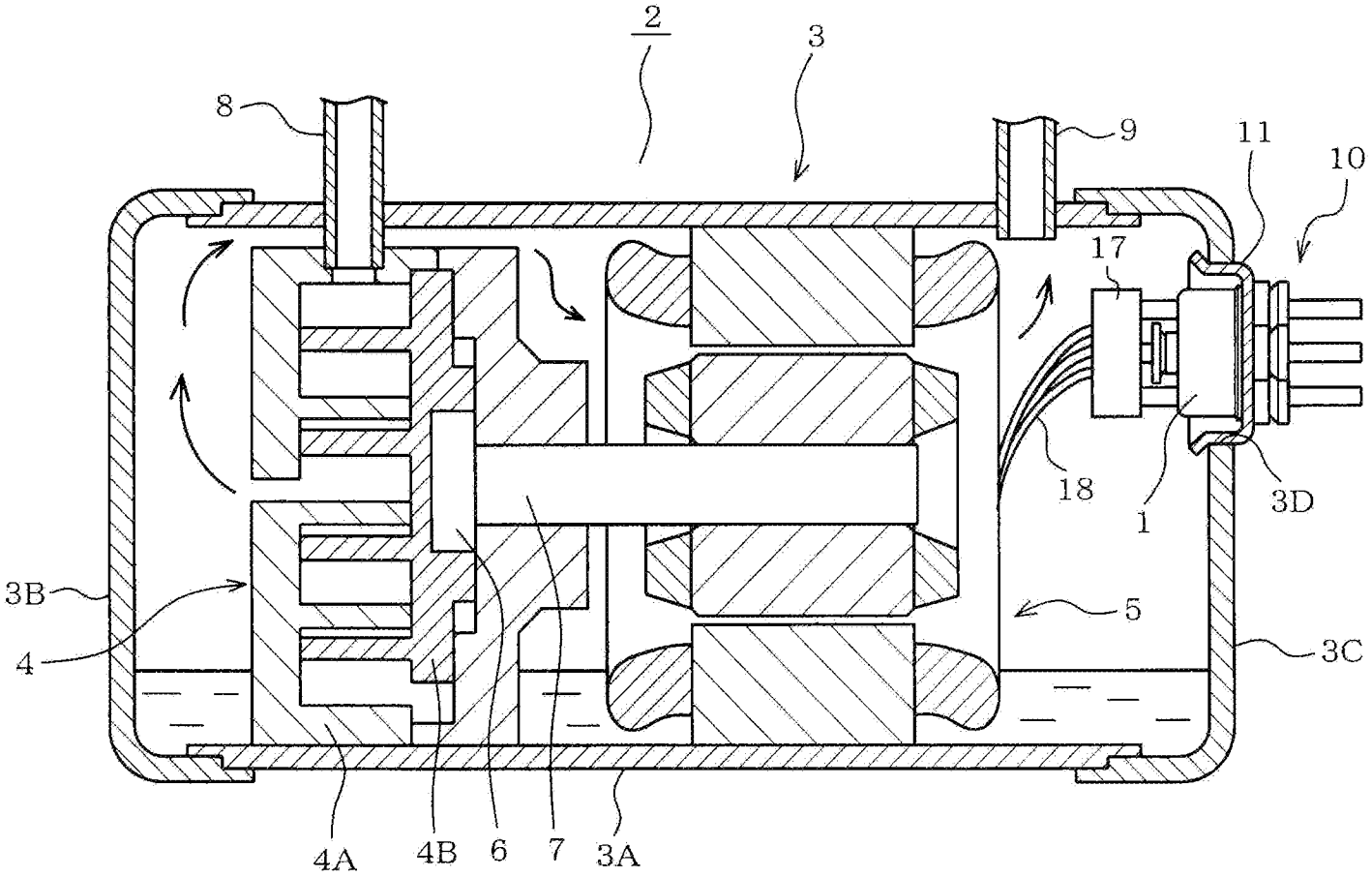
FIG. 7 is a longitudinal side section of an example of hermetically sealed electric compressor.

One embodiment will be described with reference to the drawings. FIG. 7 shows an example of horizontal hermetically sealed scroll electric compressor 2 provided with the thermally responsive switch 1. The compressor 2 is of a high-pressure housing type in which an entire compressor housing 3, made of metal, serves as a passage for discharged refrigerant after compression. The compressor housing 3 includes three parts, that is, a central part 3A with both open ends, a housing end cap 3B hermetically covering one end side (the left side as viewed in FIG. 7) of the central part 3A, and a housing end cap 3C hermetically covering the other end side (the right side as viewed in FIG. 7) of the central part 3A.

A scroll compressor 4 and an electric motor 5 are accommodated in the compressor housing 3. The scroll compressor 4 is disposed at the housing end cap 3B side in the central part 3A of the compressor housing 3. The motor 5 is disposed at the housing end cap 3C side in the central part 3A of the compressor housing 3. The scroll compressor 4 comprises a fixed scroll 4A and a movable scroll 4B. The movable scroll 4B is driven via a crank 6 and a drive shaft 7 by the motor 5.

A suction pipe 8 and a discharge pipe 9 are provided on an upper part of the compressor housing 3. The suction pipe 8 extends through a part of the compressor housing 3, located at the scroll compressor 4 side, and is hermetically fixed in position. The suction pipe 8 is connected to the fixed scroll 4A to supply sucked refrigerant into the scroll compressor 4. The discharge pipe 9 extends through a part of the compressor housing 3 located at the motor 5 side (located on the right of the motor 5, as viewed in FIG. 7) and is hermetically fixed in position. The refrigerant, compressed by the scroll compressor 4, flows in the compressor housing 3, as shown by arrows in FIG. 7, thereby to be supplied through the discharge pipe 9 into a freezing unit (not shown).

The compressor housing 3 has a through hole 3D formed in the housing end cap 3C. A hermetic conductive terminal 10 is hermetically fixed in the hole 3D. The hermetic conductive terminal 10 is provided for electrically connecting an interior and exterior of the compressor housing 3. The thermally responsive switch 1 is provided on the inside of a bottomed cylindrical metal plate 11 constituting the hermetic conductive terminal 10 (or on the inside of the compressor housing 3).

Figure 1:
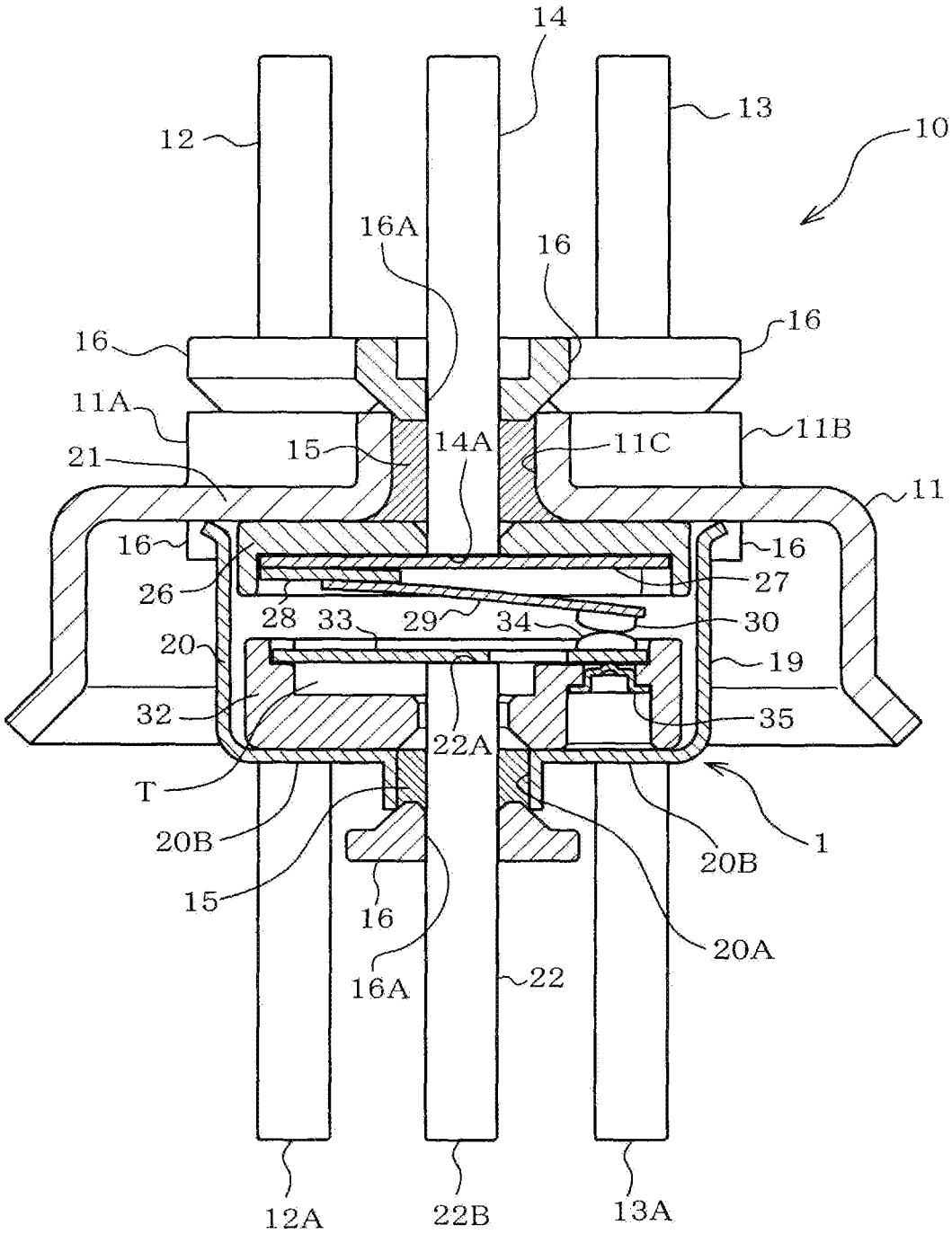
FIG. 1 is a longitudinal side section of a thermally responsive switch and its peripheral configuration in accordance with one embodiment.

The structure of the thermally responsive switch 1 will now be described with reference to FIGS. 1 to 6. Referring to FIG. 1, the thermally responsive switch 1 and the peripheral structure are shown. The metal plate 11 of the hermetic conductive terminal 10 has three circularly cylindrical through holes 11A to 11C formed by a burring process. A greater or fewer (i.e., a plurality) number of holes 11A to 11C may be employed without departing from the scope of the present invention. Conductive terminal pins 12 to 14 are inserted through the holes 11A to 11C respectively. The terminal pins 12 to 14 are insulated and fixed by an electrically insulating filler 15, such as glass. Selection of the electrically insulated filler 15 is determined in view of a thermal expansion coefficient. The filler 15 also may be selected based on well known properties for hermetic seals of the compression type. In this case, the holes 11A to 11C are formed so as to extend outwardly such that a certain thickness of the filler 15 in the holes 11A to 11C is ensured.

Three heat-resistant inorganic insulating members 16 are tightly fixed to the filler 15 for each of the terminal pins 12 to 14 respectively. Each insulating member 16 comprises ceramics, such as zirconia (zirconium oxide), selected for physical strength such as electrical strength against creeping discharge and also heat resistance against sputter. In this case, each insulating member 16 is formed into the shape of a ring having a central insertion hole 16A through which each of the conductive terminal pins 12 to 14 is inserted. Furthermore, each of the insulating members 16 disposed on an outer part of the terminal 10 has a circumferential edge cut and raised outward for the purpose of ensuring a creeping distance.

The aforementioned insulating members 16 can improve the dielectric strength between the terminal pins 12-14 and the metal plate 11, whereupon generation and transition of an arc can be prevented between the terminal pins 12-14 and the metal plate 11 or between the terminal pins 12-14. Additionally, two other insulating members 16 disposed on an inner part of the terminal 10 are each formed into the shape of a flat ring and have respective central insertion holes 16A therethrough. Furthermore, since the thermally responsive switch 1 is disposed at the side of the inner part of the filler 15, which insulates and fixes the terminal pin 14, no insulating member 16 is disposed at that side.

The terminal pins 12 and 13 have respective ends 12A and 13A (ends located at the side of the interior of the compressor housing 3) which are inserted into a socket 17 (see FIG. 7) at the side of the interior of the compressor housing 3. The socket 17 is connected via a lead wire 18 or the like to windings (not shown) of the motor 5. On the other hand, the terminal pin 14 has an end 14A (end located at the side of the interior of the compressor housing 3) which is located in the hermetic container 19 of the thermally responsive switch 1.

The hermetic container 19 includes a metal housing 20 which is formed so as to have an elliptically cylindrical section. A bottom and a header plate 21 are hermetically secured to an open end of the housing 20 by a ring projection welding or the like. In this case, the housing 20 is formed by drawing a steel sheet or the like using a pressing machine. The housing 20 is formed into an elliptic shape that is longer in a direction (a right-left direction in FIG. 1) substantially perpendicular to an axial direction (an up-down direction in FIG. 1) of a conductive pin 22, which will be described later. Thus, the housing 20 is formed into a long dome shape (see FIG. 5). Furthermore, both of the lengthwise ends of the housing 20 are formed so as to protrude lengthwise into a semicircular section. The header plate 21 is part of the metal plate 11 of the terminal 10. In this case, the header plate 21 (the entire metal plate 11 includes the header plate 21) is formed so as to be thicker than the housing 20.

The housing 20 has a bottom (the bottom of the hermetic container 19) that is formed with a circularly cylindrical through hole 20A protruding out of the thermally responsive switch 1 (into the compressor housing 3). The hole 20A is formed by the burring process. A conductive pin 22 is inserted through and hermetically sealed in the hole 20A. The conductive pin 22 is insulated and fixed in the hole 20A by the filler 15. Furthermore, another ring-shaped heat-resistant inorganic insulating member 16, having a central insertion hole 16A, is tightly fixed to the filler 15 surrounding the conductive pin 22. As a result, the dielectric strength can be improved between the conductive pin 22 and the housing 20. Accordingly, electric arc generation and transition can be prevented between the conductive pin 22 and the housing 20. The conductive pin 22 has an end 22A located in the hermetic container 19 and another end 22B (located inside the compressor housing 3) inserted into the socket 17, whereupon the end 22B is connected via the socket 17 to the motor 5.

Figure 2:
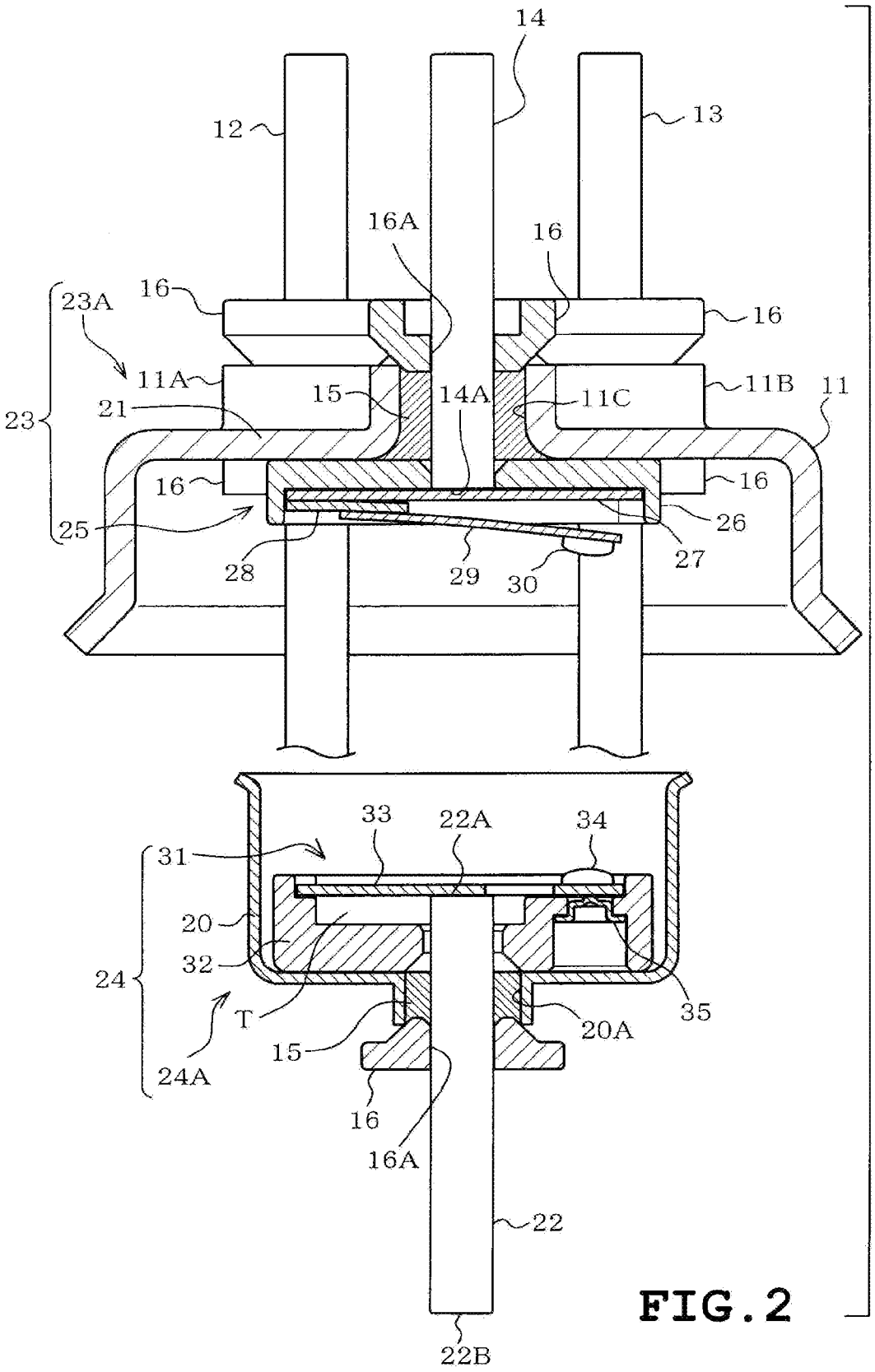
FIG. 2 is a longitudinal side section of the header plate assembly and the housing assembly.
Figure 3:
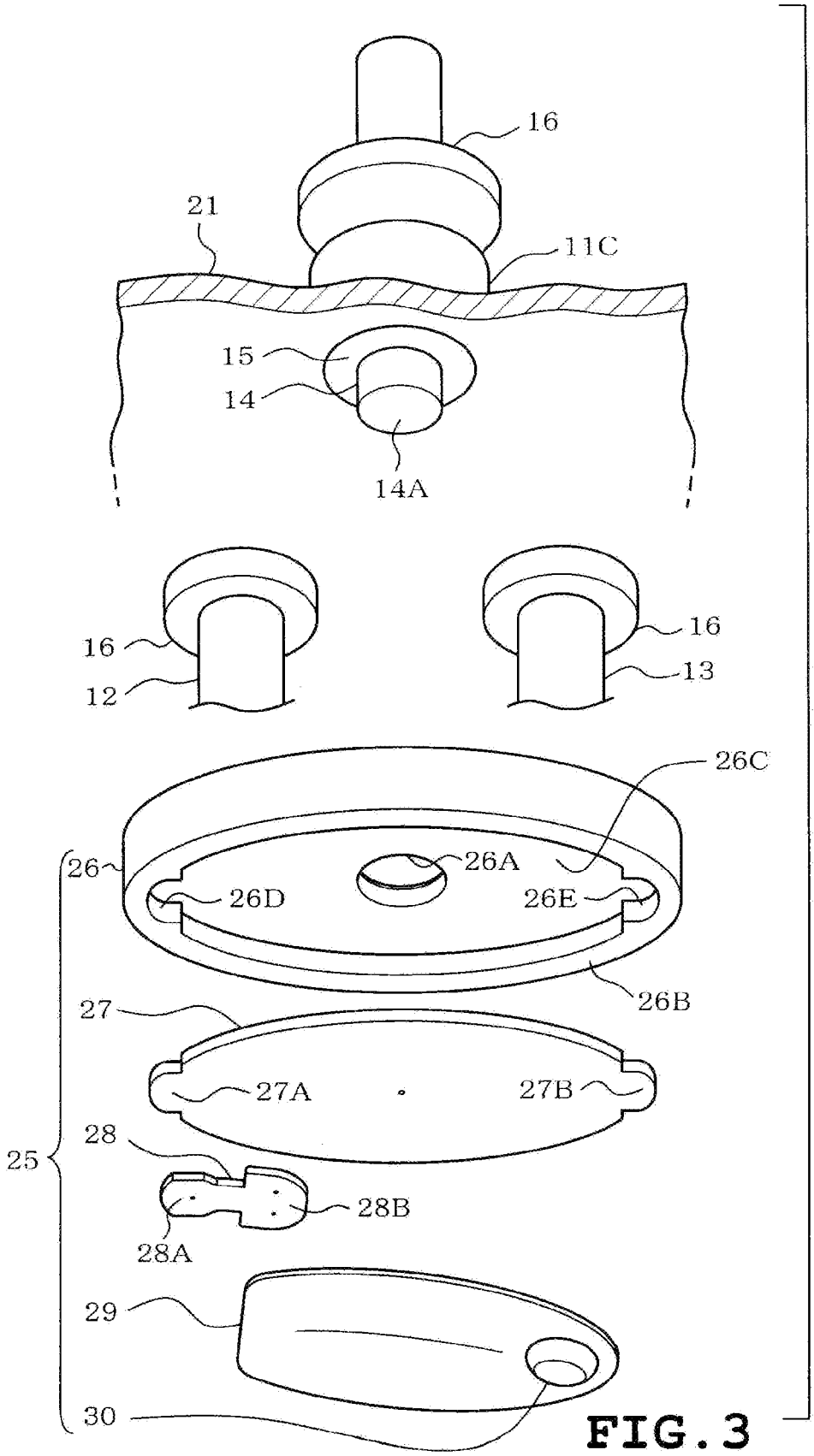
FIG. 3 is an exploded perspective view of the header plate assembly.

The thermally responsive switch 1 comprises a header plate assembly 23 and a housing assembly 24 as shown in FIG. 2. The header plate assembly 23 comprises a header plate subassembly 23A and a movable contact assembly 25. In the header plate subassembly 23A, the hole 11C is formed through the metal plate 11 of the terminal 10, and the terminal pin 14 is inserted through and hermetically fixed in the hole 11C by the filler 15. The movable contact assembly 25 comprises a ceramic member 26, a metal base plate 27, a metal support 28, a thermally responsive plate 29 and a movable contact 30.

The ceramic member 26 is formed into an elliptic shape conforming to the inner peripheral surface of the housing 20 and has a centrally located insertion hole 26A through which the terminal pin 14 is inserted. The ceramic member 26 further has an elliptically annular outer peripheral wall 26B conforming to a periphery of the ceramic member 26 and an elliptic recess 26C surrounded by the outer peripheral wall 26B. The outer peripheral wall 26B has notches 26D and 26E at the lengthwise ends, both of which are formed by cutting out the ends respectively.

The base plate 27 is formed into an elliptic shape that has substantially the same shape as the entire recess 26C of the ceramic member 26. The terminal pin 14 has an end 14A which is connected and fixed via the ceramic member 26 to a central part of the base plate 27 by welding or the like. Furthermore, the base plate 27 has protrusions 27A and 27B formed at both lengthwise ends, which protrude in the lengthwise direction. The protrusions 27A and 27B are adapted to be fitted into the notches 26D and 26E, respectively.

Figure 4:
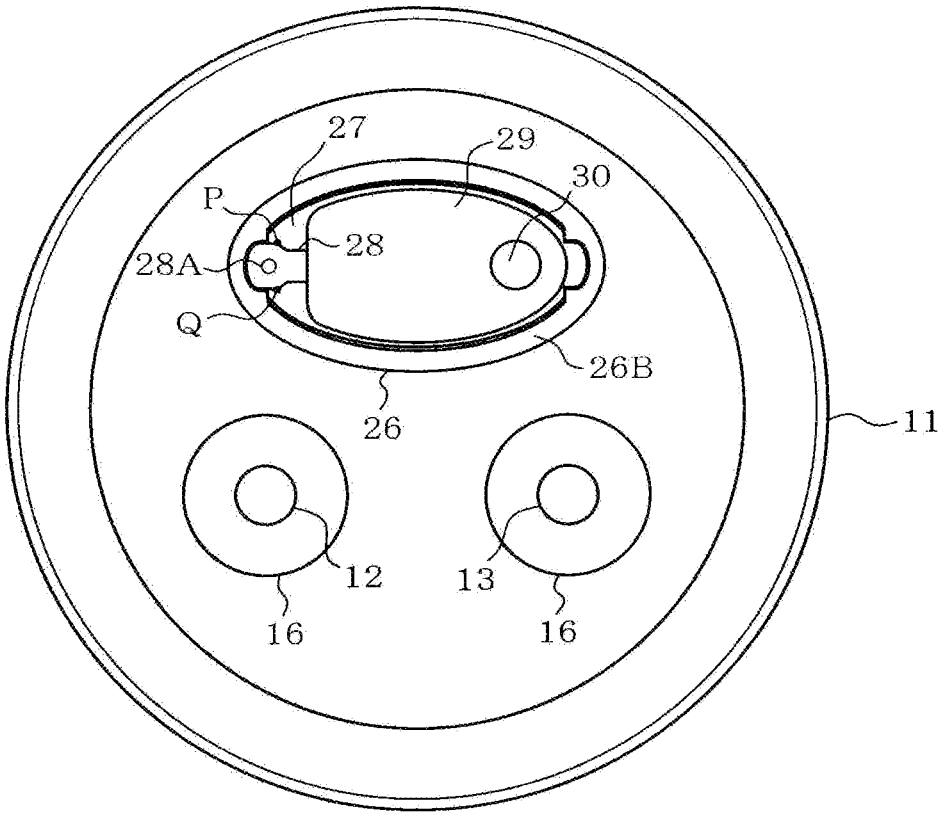
FIG. 4 is a bottom view of the header plate assembly and its periphery.
Figure 5:
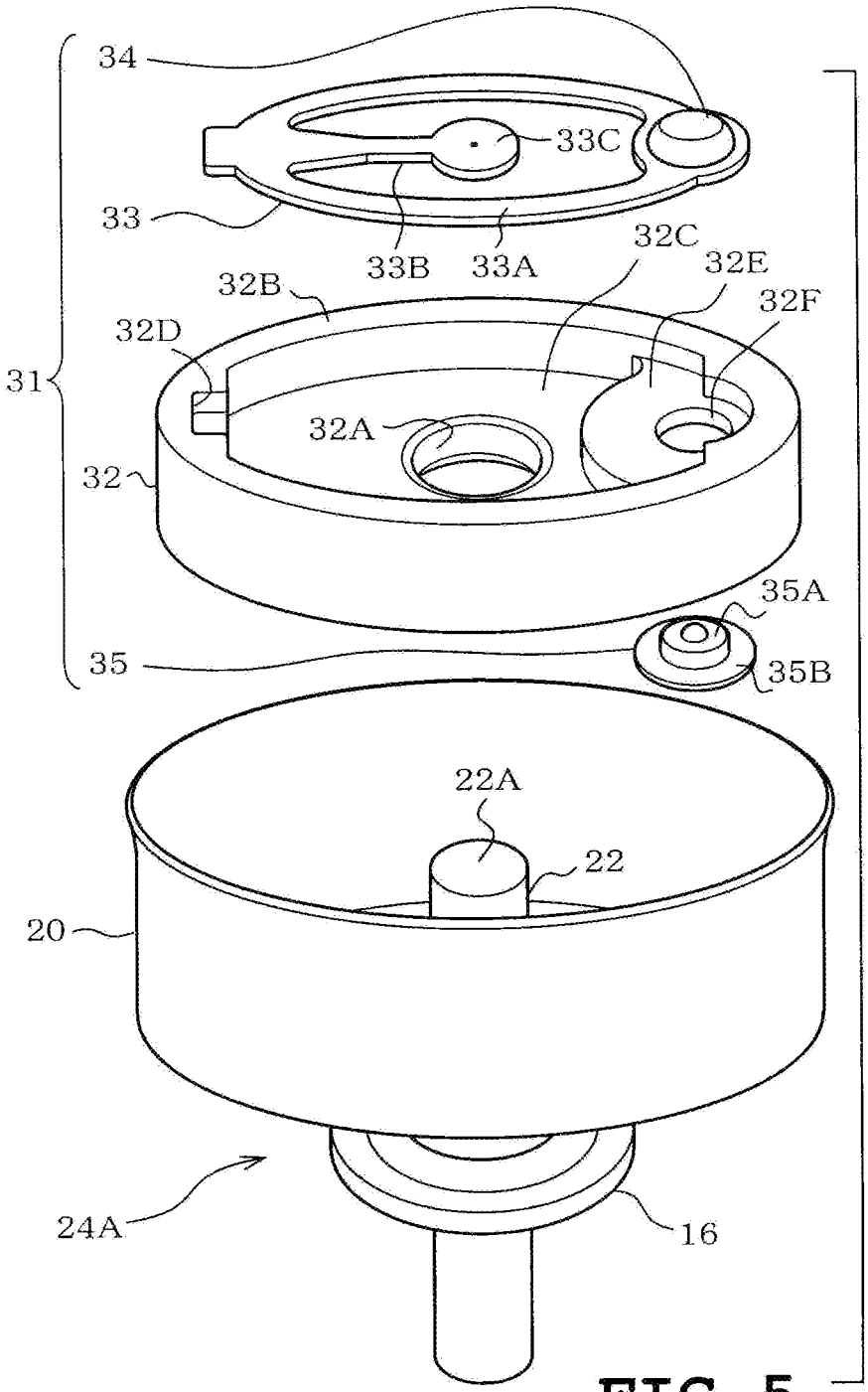
FIG. 5 is an exploded perspective view of the housing assembly.

The support 28 has a weld portion 28A extending lengthwise and another weld portion 28B extending in a direction perpendicular to the lengthwise direction. The weld portion 28B has a larger width than the weld portion 28A. The weld portion 28B is provided so as to be slightly inclined downward, relative to the weld portion 28A. The weld portion 28A is secured to the protrusion 27A of the base plate 27 by welding, and the weld portion 28B is secured to an end of the thermally responsive plate 29 by welding. In this case, the weld portion 28A is welded by causing electric current to flow between the weld portion 28A and two points P and Q between which the weld portion 28A is interposed on the base plate 27, as shown in FIG. 4.

The thermally responsive plate 29 has a substantially elliptic shape and has a straight portion formed by cutting off an end thereof. The straight portion extends in a direction perpendicular to the lengthwise direction of the thermally responsive plate 29. The thermally responsive plate 29 includes a part which is near the straight portion and is to be welded to the aforementioned weld portion 28B. The thermally responsive plate 29 is formed by drawing a thermally deformable material such as bimetal or trimetal into the shape of a shallow dish. The thermally responsive plate 29 is constructed to reverse its curvature with a snap action when reaching a predetermined temperature. The thermally responsive plate 29 is disposed in the elliptic recess 26C, with a space being defined between the outer peripheral wall 26B of the ceramic member 26 and the thermally responsive plate 29, as shown in FIG. 4.

The movable contact 30 is secured to the other end of the thermally responsive plate 29 by welding. The movable contact 30 contains a metal oxide and is formed into the shape of a disc. The movable contact 30 has a slightly convex contact surface (spherical surface).

The header plate assembly 23 comprising the above-described members is contemplated to be assembled as follows. Firstly, the ceramic member 26 is arranged opposite the header plate 21 (a part of the metal plate 11 including the terminal pin 14 and the filler 15) with the terminal pin 14 being inserted into the insertion hole 26A. Secondly, the base plate 27 is placed in the recess 26C of the ceramic member 26, and a central part of the base plate 27 is welded to the end 14A of the terminal pin 14. Subsequently, the weld portion 28B of the support 28 is welded near the straight portion of the thermally responsive plate 29 to which the movable contact 30 has been welded. As a result, the header plate assembly 23 comprising the header plate 21 and the movable contact assembly 25 is thus assembled. In the illustrated embodiment, the thermally responsive plate 29 is welded and fixed via the support 28 to the base plate 27. However, the thermally responsive plate 29 may be fixed directly to the base plate 27 when the characteristics of the thermally responsive plate 29 are not adversely affected.

The housing assembly 24 will now be described. The housing assembly 24 includes a housing subassembly 24A and a fixed contact assembly 31 accommodated in the housing subassembly 24A as shown in FIG. 2. In the housing subassembly 24A, the conductive pin 22 is inserted through the hole 20A provided in the housing 20 and is fixed in position by the filler 15. The fixed contact assembly 31 comprises a metal electrical conductor 33, a fixed contact 34, a metal holder 35. The conductor 33 provided with the fixed contact 34 is fixed to the ceramic member 32 by the holder 35.

The ceramic member 32 is formed into an elliptic shape conforming to the inner circumferential surface of the housing 20, and has in a central part thereof, an insertion hole 32A through which the conductive pin 22 is inserted. The insertion hole 32A has a larger diameter than the conductive pin 22. The ceramic member 32 is adapted to be disposed so as to be movable in the housing 20 (the hermetic container 19) in the axial direction with respect to the conductive pin 22. Furthermore, the ceramic member 32 has an elliptically annular outer peripheral wall 32B and a recess 32C surrounded by the outer peripheral wall 32B. The ceramic member 32 has a notch 32D formed in one end of the recess 32C (the left side as viewed in FIG. 5) by lengthwise cutting out the part thereof. On the other hand, the other end of the recess 32C (the right side as viewed in FIG. 5) is formed with a stepped portion 32E inwardly extending in an arc shape toward the center of the recess 32C. The stepped portion 32E has an insertion hole 32F formed substantially in the middle thereof so that a protrusion 35A of the holder 35, which will be described later, is insertable into the insertion hole 32F.

Figure 6:
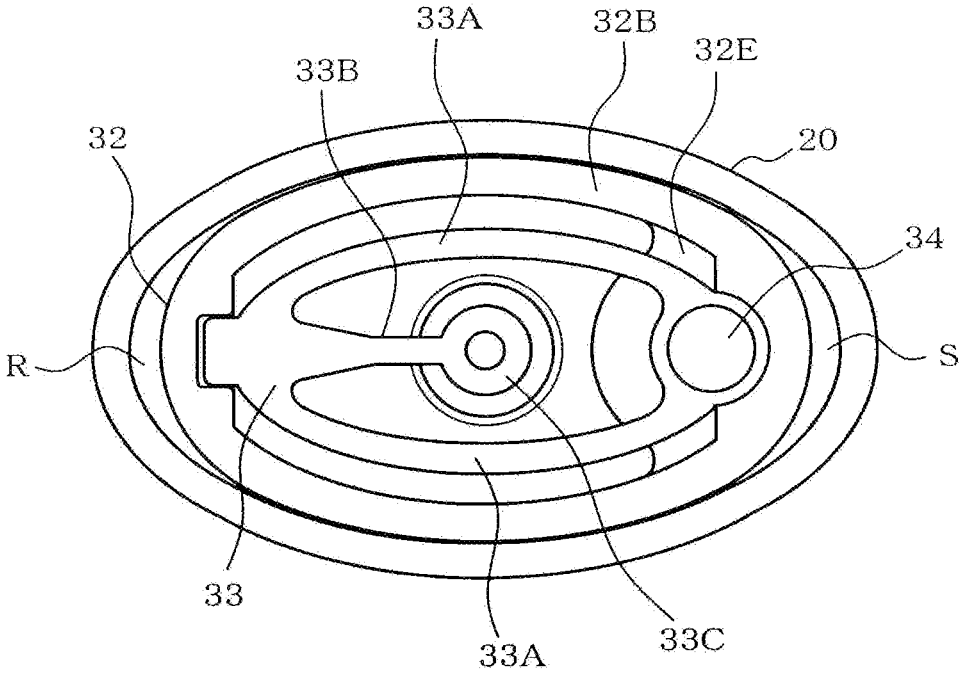
FIG. 6 is a plan view of the housing assembly.

The ceramic member 32 is adapted to be disposed so that substantially the entire side periphery thereof (the part other than both lengthwise ends) is in abutment with the inner peripheral surface of the housing 20, as shown in FIG. 6. Thus, the movement of the ceramic member 32 is limited by the inner peripheral surface of the housing 20. As a result, the ceramic member 32 is disposed in the housing 20 (the hermetic container 19) so as to be unrotatable. In this case, spaces R and S are defined between the lengthwise ends of the ceramic member 32 and the lengthwise ends of the housing 20 respectively.

The conductor 33 has a heater part 33A and a fuse part 33B both of which are formed integrally therewith. The heater part 33A is formed into an elliptically annular shape which is smaller than the outer peripheral wall 32B of the ceramic member 32. The heater part 33A is disposed in the recess 32C of the ceramic member 32 with spaces being defined between the outer peripheral wall 32B and the heater portion 33A as shown in FIG. 6. The heater part 33A is adapted to be disposed substantially in parallel to the thermally responsive plate 29. Therefore, when the housing assembly 24 has been assembled to the header plate assembly 23, as shown in FIG. 1, heat generated by the heater part 33A is efficiently transferred to the thermally responsive plate 29.

The fuse part 33B extends from one end of the heater part 33A toward the central part thereof. The fuse part 33B has a distal end connected and fixed to the end 22A of the conductive pin 22. As a result, the fuse part 33B constitutes a part of an electrical path formed between the terminal pin 14 and the conductive pin 22 (an electrical path formed by the terminal pin 14, base plate 27, support 28, thermally responsive plate 27, movable contact 30, fixed contact 34, conductor 33 and conductive pin 22). Furthermore, the fuse part 33B has a smaller sectional area than the heater part 33A.

The fixed contact 34 is secured to the other end of the conductor 33 by welding so as to be located opposite the movable contact 30. The fixed contact 34 contains a metal oxide and is formed into the shape of a disc. The fixed contact 34 has a slightly convex contact surface (spherical surface).

The holder 35 has a bottom circular cylindrical protrusion 35A and an annular flange 35B provided around an open end of the protrusion 35A. The holder 35 is inserted into the insertion hole 32F of the ceramic member 32 from the backside (i.e., a position beneath the stepped portion 32E), and the other end of the conductor 33 is welded to the protrusion 35A. As a result, the fixed contact 34, which is welded to the other end of the conductor 33, is adapted to be fixed to the other end of the ceramic member 32 (an upper part of the stepped portion 32E).

The housing assembly 24 comprising the above-described members is assembled as follows. Firstly, the conductor 33, with the end to which the fixed contact 34 is welded, is placed in the recess 32C of the ceramic member 32. Subsequently, the holder 35 is welded to the end of the conductor 33 from the backside of the ceramic member 32, whereby the fixed contact 34 is fixed to the end of the ceramic member 32. The ceramic member 32, with the fixed contact 34 affixed thereto, is disposed in the housing 20 with the conductive pin 22 being inserted into the insertion hole 32A. The circular distal end 33C formed on the fuse part 33B of the conductor 33 is then welded to the end 22A of the conductive pin 22, whereby the housing assembly 24 comprising the housing 20 and the fixed contact assembly 31 is assembled. The fixed contact 34 is indirectly supported by the fuse part 33B in the housing assembly 24. Furthermore, a space T is defined between the upper surface of the recess C and the conductor 33 as shown in FIGS. 1 and 2.

The header plate 21 of the header plate assembly 23 and an open end of the housing 20 of the housing assembly 24 are hermetically welded together while the interior of the container 19 is filled with a gas with a predetermined pressure. This completes the assembly of the thermally responsive switch 1. The ceramic member 26 is disposed between the movable contact 30 and the hermetic container 19 in the thermally responsive switch 1 (particularly, within the peripheries defined by the header plate 21 and the open end of the housing 20). Furthermore, the ceramic member 32 is disposed between the fixed contact 34 and the container 19 (particularly, the bottom of the housing 20 and the periphery thereof).

A switching contact comprising the movable contact 30 and the fixed contact 34 is formed between the terminal pin 14 and the conductive pin 22 in the interior of the thermally responsive switch 1. When the temperature of the refrigerant is abnormally high in the interior of the compressor 2 or when an abnormal current flows in the motor 5, among other variables, the thermally responsive plate 29 reverses its curvature to open the contacts 30 and 34, thereby interrupting electric supply to the motor 5. Furthermore, when the temperature of the refrigerant or the current value of the motor 5 is reduced to or below a predetermined value such that the interior temperature of the switch 1 drops, the contacts 30 and 34 are re-closed so that the motor 5 is energized.

The fuse part 33B is not melted down during a normal operation of the scroll compressor 4, which is the equipment to be controlled by the operation thereof. Furthermore, when the motor 5 is in a locked rotor condition, heat generated by the heater part 33B reverses the thermally responsive plate 29 in a short period of time to open the contacts 30 and 34. In this case, too, the fuse part 33B does not melt. However, after the thermally responsive switch 1 repeats switching of the contacts 30 and 33B over a predetermined number of times of operation, the movable and fixed contacts 30 and 34 adhere to each other such that the movable and fixed contacts 30 and 34 cannot be separated from each other in some instances. When the rotor of the motor 5 is locked in this case, an excessive current raises the temperature of the fuse part 33B causing the fuse part 33B to melt, whereupon the motor 5 can be interrupted reliably.

A calibration process will be described in which a reversing temperature of the thermally responsive switch 29 is calibrated after assembly of the thermally responsive switch 1. The degree to which the thermally responsive plate 29 is bent (or shaped) after the drawing process varies due to differences in the characteristics of the thermally responsive plate 29, machining variance resulting from the drawing process, and the like. Furthermore, the shape and dimensions of the thermally responsive switch 1 are contemplated to vary due to welding or the like during manufacture of the header plate assembly 23 and the housing assembly 24 and also during assembly of the thermally responsive switch 1. Still further, the thermally responsive switch 1 varies slightly in the shapes of the components constituting the header plate assembly 23 and the housing assembly 24. As a result, a contact pressure between the movable and fixed contacts 30 and 34 constituting the switching contact needs to be adjusted so that a reversing temperature of the thermally responsive plate 29 is calibrated into a desired, specified value.

In the calibrating process, calibrating portions 20B of the bottom of the housing 20 (the hermetic container 19) are deformed in the axial direction of the conductive pin 22. The deformation is contemplated to be performed, from an initial shape to a deformed shape, while at least the bottom portion of the housing 20 is immersed in oil maintained at the specified reversing temperature until the curvature of the thermally responsive plate 29 is reversed, respectively. The calibrating portions 20B refer to both lengthwise ends of the bottom of the housing 20 with the conductive pin 22 being interposed therebetween, as shown in FIG. 1, respectively. In this case, the calibrating portions 20B of the housing 20 are collapsed from outside the housing 20 (collapsing temperature adjustment).

When both bottom ends (the calibrating portions 20B) of the housing 20 are thus deformed in the axial direction of the conductive pin 22, the fixed contact 34 and the ceramic member 32 move together with one another in the axial direction of the conductive pin 22. The reversing temperature of the thermally responsive plate 29 is calibrated in connection with the movement of the fixed contact 34 and the ceramic member 32. In this case, the fuse part 33B is inclined downward between one end of the conductor 33 and the end 22A of the conductive pin 22. However, since the space T is defined between the upper surface of the recess 22C of the ceramic member 32 and the conductive member 33, it is unlikely that the fuse part 33B will come into contact with the ceramic member 32 (in particular, the upper surface of the recess 32C) after calibration.

According to the thermally responsive switch 1 described above, the fixed contact 34 is fixed to the electrically insulating ceramic member 32 disposed between the hermetic container 19 and the fixed contact 34. As a result, even if an excessive current melts down the fuse part 33B, which indirectly supports the fixed contact 34, the ceramic member 32 can prevent the fixed contact 34 from contacting the hermetic container 19.

Furthermore, the header plate 21 comprises a part of the hermetically sealed conductive terminal 10 hermetically fixed to the housing of the hermetic electric compressor (the compressor housing 3). The hermetic container 19 of the thermally responsive switch 1 is provided in the interior of the compressor housing 3. According to this construction, since the terminal 10 and the thermally responsive switch 1 are formed integrally with each other, the conventionally-required effort associated with mounting the thermally responsive switch 1 can be eliminated. The effort of connecting the terminal 10 outside the compressor 2 can be eliminated. Furthermore, since the connection between the thermally responsive switch 1 and the terminal 10 is disposed in the compressor housing 3, the reliability of the thermally responsive switch 1 and accordingly the compressor 2 can be improved.

Furthermore, the thermally responsive switch 1 is operated only by the current flowing in the electric motor 5, as in the case where the thermally responsive switch is disposed outside the compressor 2. On the other hand, since the thermally responsive switch 1 is disposed inside the compressor 2, the thermally responsive switch 1 is operated in response to the temperature of refrigerant in the compressor 2 as well as by the current flowing in the electric motor 5. As a result, the thermally responsive switch 1 can function as an accurate thermal protector.

The ceramic member 32 is movable in the axial direction of the conductive pin 22 in the hermetic container 19 of the thermally responsive switch 1. The operating temperature of the thermally responsive switch 1 is calibratable by deforming the calibrating portions 20B in the bottom of the housing 20 in the axial direction of the conductive pin 22 from their initial shape. According to the construction, when the calibrating portion 20B is deformed in the axial direction of the conductive pin 22 from the initial shape, the operating temperature is calibratable while the fixed contact 34 and the ceramic member 32 are moved together with each other. As a result, angular variations of the fixed contact 34 with respect to the movable contact 30 can be reduced during temperature calibration, permitting the operating temperature to be calibrated more accurately.

The housing 20 is formed into the elliptic shape and is elongated in the direction substantially perpendicular to the axial direction of the conductive pin 22. The ceramic member 32 is formed into an elliptic shape conforming to the inner peripheral surface of the housing 20. According to the construction, the ceramic member 32 is limited by the inner peripheral surface of the housing 20. Thus, the ceramic member 32 does not rotate in the hermetic container 19. As a result, even when the fuse part 33B has been melted down, the fixed contact 34 also does not rotate together with the ceramic member 32. This renders the fixed contact 34 and the ceramic member 32 stationary (i.e., non-rotatable), whereupon the contact of the fixed contact 34 with the hermetic container 19 can be reduced further.

The ceramic member 32 has the recess 32C surrounded by the elliptically annular outer peripheral wall 32B. The conductor 33 is formed into the elliptically annular shape so as to be located inside the outer peripheral wall 32B. The fixed contact 34 is attached to the other end of the conductor 33 and then fixed to the ceramic member 32. According to this construction, since the fixed contact 34 and the conductor 33 are surrounded by the outer peripheral wall 32B, both the fixed contact and the heater 33A of the conductor 33 can be prevented from the contact with the hermetic container 19 after a meltdown of the fuse part 33B.

The above-described embodiment should not be restrictive but may be modified or expanded as follows, for example. A fuse directly supporting the fixed contact 34 in the hermetic container 19 may be provided instead of the fuse part 33B constituting apart of the conductor 33.

The housing 20 should not be limited to the long dome shape with the elliptically cylindrical section. For example, when a predetermined strength can be obtained by provision of ribs in the lengthwise direction of the housing 20 or the like, the housing 20 may or may not be formed into the long dome shape with the elliptically cylindrical section.

The ceramic member 32 should not be limited to the elliptic shape conforming to the inner peripheral surface of the housing 20. For example, the ceramic member 32 may be formed into a semielliptical shape and occupy one half of the area of the housing 20. Furthermore, although the ceramic member 32 is formed so that a substantially entire side periphery thereof is in abutment with the inner peripheral surface of the housing 20, the ceramic member 32 should not be limited to such a construction. For example, a part of the side periphery of the ceramic member 32 may be supported by a support pin provided on the housing 20 or the like so as to discourage rotation within the hermetic container 19.

Furthermore, when the housing 20 or the ceramic member 32 has been deformed, the other members (the conductor 33 and the like) may be deformed according to the shape of the deformed housing 20 or the ceramic member 32.

The calibration of the reversing temperature of the thermally responsive plate 29 can be executed using a pressing apparatus (provided with a holding portion which holds the housing 20) and a temperature adjusting head which presses the calibrating portions 20B of the housing 20 (held by the holding portion).

The heat-resistant inorganic insulating members 16 may or may not be provided. The insulating members 16 may be eliminated when a sufficient creeping distance can be obtained on the surface of the filler 15 or when the thermally responsive switch 1 is used in an environment where substantially no smudge inhibiting insulation adheres to the thermally responsive switch 1.

Two or more pairs of switching contacts including the movable contacts 30 and the fixed contacts 34. Furthermore, the movable and fixed contacts 30 and 34 may be formed into a crossbar contact in which the movable and fixed contacts 30 and 34 are normal to each other. In this construction, a sufficient contact pressure can be obtained between the contacts even when current is small.

The thermally responsive switch 1 may be used in a vertical hermetically sealed electric compressor as well as in the horizontal hermetically sealed scroll electric compressor 2. Additionally, the thermally responsive switch 1 may be provided in a low-pressure housing type hermetically sealed electric compressor in which the motor 5 is disposed in a low-pressure area serving as a suction side and the scroll compressor 4 is disposed in a high-pressure area serving as a discharge side.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

The invention claimed is:

1. A thermally responsive switch which is used to interrupt AC current flowing into an electric motor provided in a hermetic electric compressor, the switch comprising:

a hermetic container including a metal housing and a header plate hermetically secured to an open end of the housing, the housing being formed into a cylindrical shape and having a bottom;

a conductive terminal pin inserted through a through hole formed through the header plate and hermetically fixed in the through hole by an electrically insulating filler;

a conductive pin inserted through a through hole formed through the bottom of the housing and hermetically fixed in the through hole by the electrically insulating filler;

a thermally responsive plate having one of two ends conductively connected and fixed to the conductive terminal pin in the hermetic container, the thermally responsive plate being formed into a dish shape by drawing so as to reverse a direction of curvature thereof at a predetermined temperature;

a movable contact secured to the other end of the thermally responsive plate; and a fixed contact fixed via an electrical conductor to the terminal pin in the container, the conductor having a fuse part and a heater, the fixed contact constituting a pair of switching contacts together with the movable contact, wherein the fixed contact is fixed to an electrically insulating ceramic member disposed between the container and the fixed contact;

the ceramic member is disposed so as to be movable axially relative to the terminal pin in the container; and the housing includes a bottom surface further including both lengthwise ends between which the conductive pin is interposed, said both ends of the bottom surface of the housing being deformed axially relative to the conductive pin from an initial state, whereby an operating temperature of the thermally responsive switch is calibratable.

2. The thermally responsive switch according to claim 1, wherein:

the compressor includes a housing to which a hermetic conductive terminal is fixed;

the header plate is constituted by a part of the terminal; and the container is provided in the housing of the compressor.

3. The thermally responsive switch according to claim 1, wherein:

the housing is formed into an elliptic shape that is long in a direction substantially perpendicular to an axial direction of the conductive pin; and the ceramic member is formed into an elliptic shape along with an inner circumferential surface of the housing.

4. The thermally responsive switch according to claim 2, wherein:

the housing is formed into an elliptic shape that is long in a direction substantially perpendicular to an axial direction of the conductive pin; and the ceramic member is formed into an elliptic shape along with an inner circumferential surface of the housing.

5. The thermally responsive switch according to claim 1, wherein:

the ceramic member has a recess surrounded by an outer elliptic annular circumference wall;

the conductor is formed into an elliptic annular shape and located inside the circumferential wall; and the fixed contact is attached to the other end of the conductor and thereafter fixed to the ceramic member in the recess.

6. The thermally responsive switch according to claim 2, wherein:

the ceramic member has a recess surrounded by an outer elliptic annular circumference wall;

the conductor is formed into an elliptic annular shape and located inside the circumferential wall; and the fixed contact is attached to the other end of the conductor and thereafter fixed to the ceramic member in the recess.

7. The thermally responsive switch according to claim 3, wherein:

the ceramic member has a recess surrounded by an outer elliptic annular circumference wall;

the conductor is formed into an elliptic annular shape and located inside the circumferential wall; and the fixed contact is attached to the other end of the conductor and thereafter fixed to the ceramic member in the recess.

8. The thermally responsive switch according to claim 4, wherein:

the ceramic member has a recess surrounded by an outer elliptic annular circumference wall;

the conductor is formed into an elliptic annular shape and located inside the circumferential wall; and the fixed contact is attached to the other end of the conductor and thereafter fixed to the ceramic member in the recess.

* * * * *